United States Patent [19]

Mauch

[11] 4,111,103

[45] Sep. 5, 1978

[54] THRUST RINGS FOR SWASH PLATE PUMPS AND MOTORS

[75] Inventor: David L. Mauch, Bordman, Ohio

[73] Assignee: Commercial Shearing, Inc., Youngstown, Ohio

[21] Appl. No.: 768,393

[22] Filed: Feb. 14, 1977

[51] Int. Cl.[2] ..... F01B 13/04

[52] U.S. Cl. ..... 92/57; 91/488; 92/153

[58] Field of Search ..... 92/57, 12.2, 71, 147, 92/153, 70; 91/488, 499

[56] References Cited

U.S. PATENT DOCUMENTS

| | | | |
|---|---|---|---|
| 3,173,376 | 3/1965 | Hulman | 91/488 |
| 3,424,097 | 1/1969 | Molly | 91/499 |
| 3,641,829 | 2/1972 | Reynolds | 92/57 |
| 3,783,744 | 1/1974 | Benkovic | 91/488 |
| 3,866,518 | 2/1975 | Miyao | 91/488 |
| 3,898,917 | 8/1975 | Adams | 91/488 |
| 3,978,772 | 9/1976 | Miyao | 91/499 |

*Primary Examiner*—Martin P. Schwadron
*Assistant Examiner*—Abraham Hershkovitz
*Attorney, Agent, or Firm*—Buell, Blenko & Ziesenheim

[57] ABSTRACT

A swash plate pump or motor is provided having a swivel plate surrounding the slippers and a positive hold down ring connected to the swash plate and bearing on said swivel plate to maintain it at a fixed distance from the slipper plate, said hold down ring having a series of successive controlled wedge angles on the face bearing on the swivel plate and oil feed means connected to each wedge angle whereby a hydrodynamic force is created holding the swivel plate and hold down ring apart.

5 Claims, 7 Drawing Figures

THRUST RINGS FOR SWASH PLATE PUMPS AND MOTORS

The present invention relates to thrust rings for swash plate pumps and motors and particularly to a controlled wedge angle thrust ring for hydro-dynamically lubricated bearing for slipper hold on swash plate type pumps and motors.

Swash plate type pumps and motors are well known and widely used. A fixed clearance positive hold down ring is required in such pumps to hold the slippers to the swash plate in a pump with a vacuum inlet. Spring actuated hold downs will not work because the oil film is sucked from beneath the supporting land and the piston, on being pressurized, slams the unsupported slipper into metal to metal contact with the slipper plates causing their ultimate destruction.

The present invention provides a structure which permits higher speeds in the pumps and motors in which it is used because the angularity of contact between the slipper and slipper plate is limited, reducing damages, such as grooving of the slipper plate and rounding of the slipper edge caused by centrifugal force on the slipper tilting it about the socket center. As is known, this damaging force is directly proportional to the square of the speed and thus prior art pumps and motors were run at lower speeds than is desirable for many applications in order to limit this damaging effect. The present invention also reduces the required starting torque on a motor as compared to spring hold down type pumps.

In a pump or motor, such as here proposed the total force that the positive hold down ring must take is the resultant of (1) the reaction to the centrifugal force mentioned above in connection with slipper wear, (2) the axial inertia forces of the piston and slipper, (3) the viscous drag on the piston and (4) suction on the piston. All of the foregoing forces increase with speed. The present invention is capable of handling all such forces.

In a present preferred form of my invention, I provide a swash plate pump or motor having a swash plate, a cylinder block and cylinders rotating relatively to said swash plate, pistons in said cylinders moving generally transversely to the swash plate, drive slippers operatively connected to said pistons, and a slipper plate on said swash plate against which the slippers bear the improvement comprising a swivel plate on the opposite side of the slippers from the slipper plate, a positive hold down ring connected to the slipper plate and swash plate and bearing on said swivel plate, said hold down ring being adjustably fixed to the swash plate to maintain a fixed running clearance between the slippers and the slipper plate and having a series of successive controlled wedge angles on the face of the hold down ring adjacent the swivel plate and having at least one oil feed hole at each wedge angle whereby oil is drawn into the wedge angle through the feed hole by the rotating swivel plate and slippers to create a hydrodynamic force holding the swivel plate and hold down ring apart and supporting the total forces tending to lift the slippers from the slipper plate. The wedge angles on the hold down ring are preferably in the form of sine wave slopes formed in the face of the hold down ring facing the swivel plate.

In the foregoing general description of my invention, I have set out certain objects purposes and advantages of the invention. Other objects, purposes and advantages will be apparent from a consideration of the following description and the accompanying drawings in which.

Figure 1:
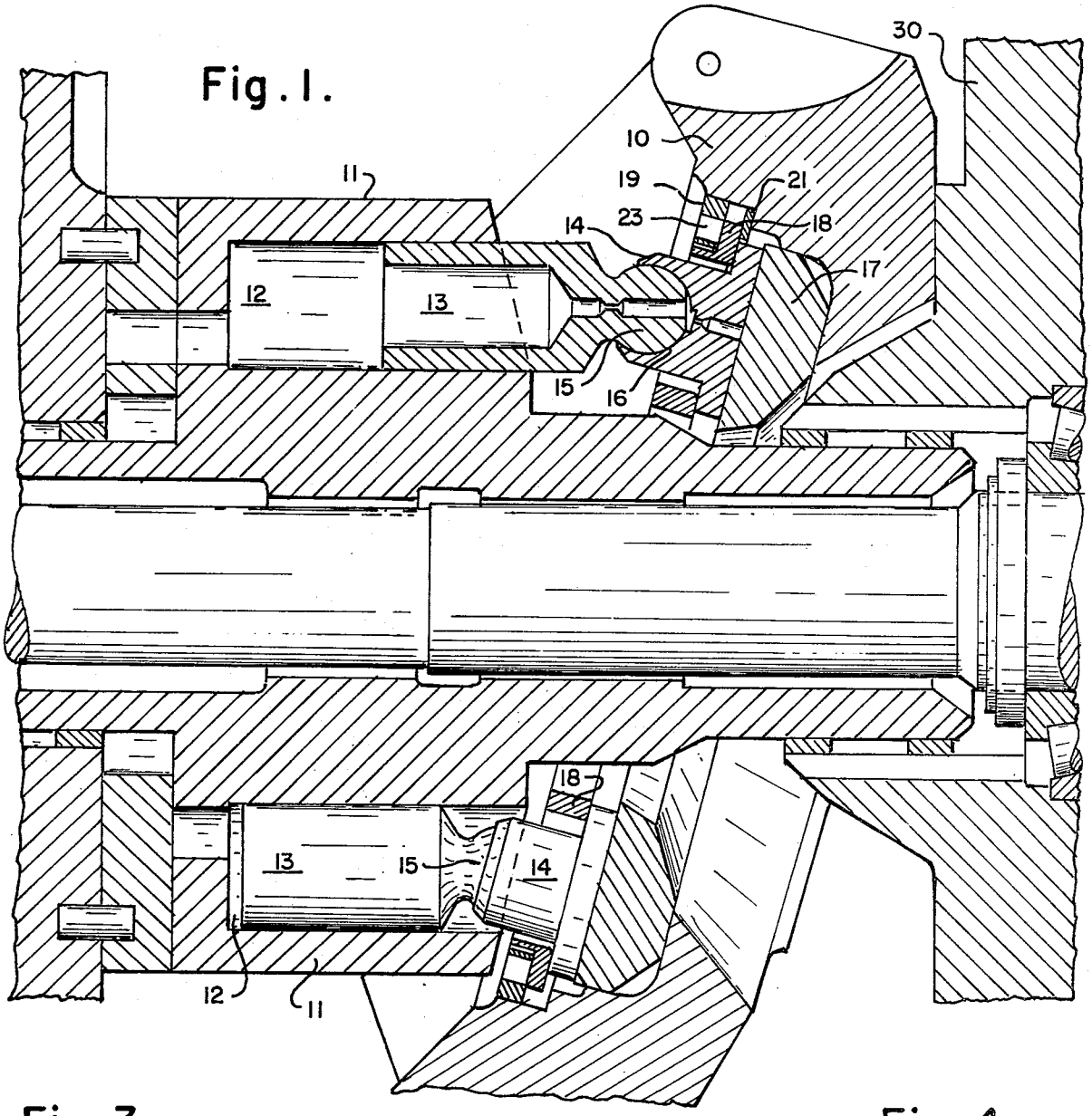
FIG. 1 is a section through a swash plate pump incorporating the thrust or hold down ring of my invention.
Figure 3:
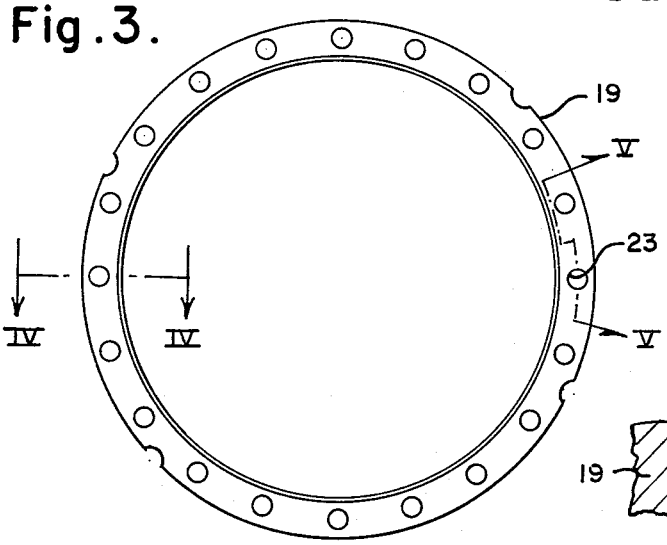
FIG. 3 is a plan view of the hold down ring of FIG. 1.
Figure 4:
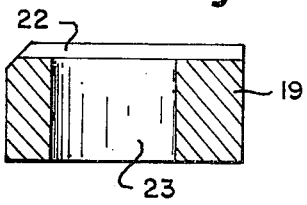
FIG. 4 is a section on the line IV—IV of FIG. 3.
Figure 5:
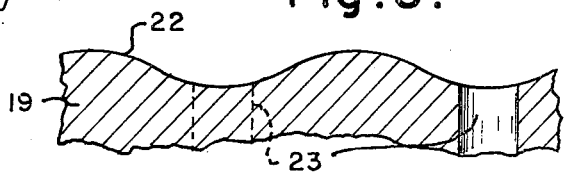
FIG. 5 is an enlarged fragmentary side elevational view of the ring of FIG. 3.
Figure 2:
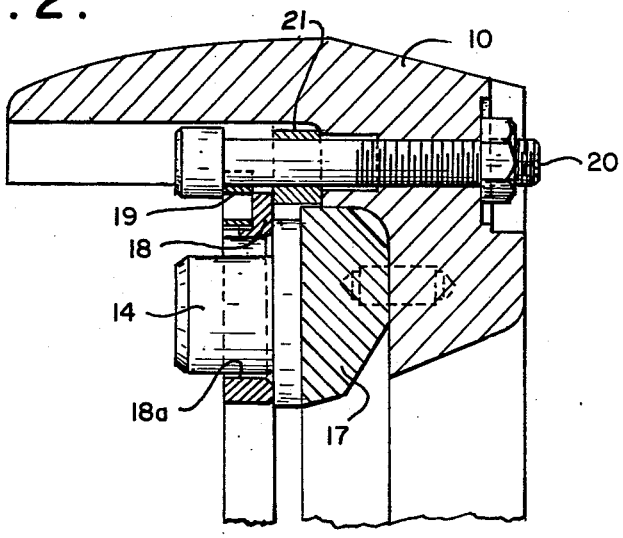
FIG. 2 is an enlarged fragmentary section of the swash plate, slipper ring slipper, swivel plate and hold down ring of FIG. 1.
Figure 6:
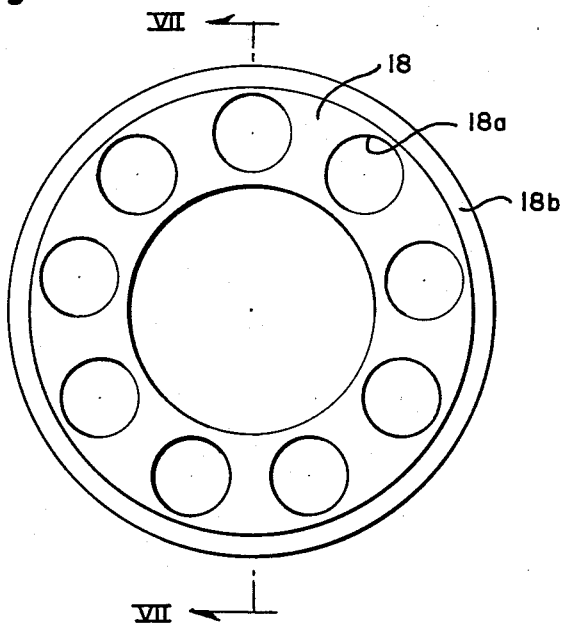
FIG. 6 is a plan view of the swivel plate of FIG. 1.
Figure 7:
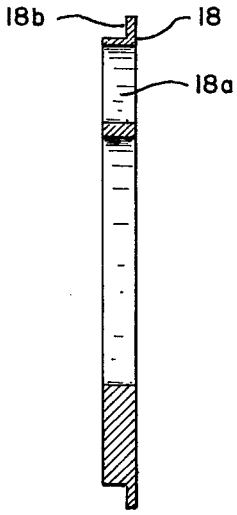
FIG. 7 is a section on the line VII—VII of FIG. 6.

Referring to the drawings, I have illustrated a swash plate 10 and a cylinder block 11 rotatable relatively thereto. The cylinder block 11 is provided with a plurality of cylinders 12 carrying pistons 13 which are operatively connected to slippers 14 through a ball 15 and socket 16 joint. The slippers 14 bear on slipper plate 17 fixed to swash plate 10. The slippers 14 are held against slipper plate 17 by swivel plate 18 which moves with the slippers 14 and is in turn held in place by a hold down ring 19. The hold down ring 19 is held to the swash plate 10 by bolts 20 and clearance is assured by shims 21. The hold down ring has a series of successive sine wave slopes 22 around its underside toward the swivel plate, each of which has a passage 23 at its deepest point for passage of oil into the sine wave area.

The swivel plate 18 is an annular ring having openings **18*a* through which the socket portion of slipper 14 projects and an annular peripheral flange 18*b* against which the hold down plate or ring 19** bears.

In operation the positive hold down ring 19, the slipper plate 17 and the swash plate 10 are fixed and the swivel plate 18 and slippers 14 rotate relative to them along with the pistons 13 and cylinder block 11. The slipper loads are transferred to swivel plate 18 which in turn rotates against positive hold down ring 19. The thrust betweeen the hold down ring 19 and swivel plate 18 is absorbed by hydrodynamic pressure built up on the sine wave slopes 22 of the hold down ring 19 caused by oil pulled from the interior of case 30 through the feed holes 23 being wedged by the rotating swivel plate 18. This hydrodynamic force holds the swivel plate 18 and hold down ring 19 apart and supports the total forces which tend to lift slippers 14 away from slipper plate 17.

In the foregoing specification, I have set out certain preferred embodiments and practices of my invention, however, it will be understood that this invention may be otherwise embodied within the scope of the following claims.

I claim:

1. In a swash plate pump or motor having a swash plate, a cylinder block and cylinders rotating relatively to said swash plate, pistons in said cylinders moving generally transversely to the swash plate, drive slippers operatively connected to said pistons and a slipper plate fixed to the swash plate against which the slippers bear, the improvement comprising a swivel plate having spaced openings for said slippers on the opposite side of said slippers from the slipper plate, a positive hold down ring connected to the swash plate and bearing on said swivel plate to maintain it at a fixed distance from the slipper plate whereby a fixed running clearance is maintained between the slipper and the slipper plate, said hold down ring having a series of successive controlled wedge angles on the face of the hold down ring adjacent the swivel plate and having oil feed means through the hold down ring and connected to each wedge angle whereby to create a hydrodynamic force holding the swivel plate and hold down ring apart.

2. A swash plate pump as claimed in claim 1 wherein the controlled wedge angles are successive sine wave slopes.

3. A swash plate pump as claimed in claim 1 wherein the oil feed means is at least one hole through the hold down ring at the wedge angle.

4. A swash plate pump as claimed in claim 2 wherein the oil feed means is at least one hole through the hold down ring at the deepest part of the sine wave.

5. A swash plate pump as claimed in claim 1 wherein the swivel plate is an annular ring having openings corresponding to and receiving the slippers and a radially extending peripheral flange extending beneath the hold down ring.

* * * * *